US008596012B2

(12) United States Patent
Franchini

(10) Patent No.: US 8,596,012 B2
(45) Date of Patent: Dec. 3, 2013

(54) FLOORING ELEMENT FOR A MODULAR FLOOR, MODULAR FLOOR OBTAINED THEREWITH AND METHOD FOR ASSEMBLING MODULAR FLOOR

(75) Inventor: Guido Franchini, Moncalieri (IT)

(73) Assignee: SEPA S.R.L., Poirino(Turin) (IT)

( * ) Notice: Subject to any disclaimer, the term of this patent is extended or adjusted under 35 U.S.C. 154(b) by 606 days.

(21) Appl. No.: 12/681,728

(22) PCT Filed: Feb. 25, 2008

(86) PCT No.: PCT/IB2008/050671

§ 371 (c)(1),
(2), (4) Date: Jun. 23, 2010

(87) PCT Pub. No.: WO2009/044299

PCT Pub. Date: Apr. 9, 2009

(65) Prior Publication Data

US 2010/0251640 A1 Oct. 7, 2010

(30) Foreign Application Priority Data

Oct. 4, 2007 (IT) ..... TO2007A0701

(51) Int. Cl.
*E04B 5/02* (2006.01)

(52) U.S. Cl.
USPC ..... 52/587.1; 52/578; 52/592.2; 52/177

(58) Field of Classification Search
USPC ..... 52/578, 588, 582, 587.1, 586.1, 589.1, 52/592.2, 177
See application file for complete search history.

(56) References Cited

U.S. PATENT DOCUMENTS

| | | | | | |
|---|---|---|---|---|---|
| 4,008,548 | A * | 2/1977 | Leclerc | 52/180 |
| 4,167,599 | A * | 9/1979 | Nissinen | 428/44 |
| 4,274,626 | A * | 6/1981 | Grosser et al. | 482/23 |
| 4,287,693 | A * | 9/1981 | Collette | 52/177 |
| 4,584,221 | A * | 4/1986 | Kung | 428/44 |
| 4,930,286 | A * | 6/1990 | Kotler | 52/177 |
| 5,428,926 | A * | 7/1995 | Melfi | 52/71 |
| 5,787,654 | A * | 8/1998 | Drost | 52/177 |
| 5,950,378 | A * | 9/1999 | Council et al. | 52/177 |
| 6,098,354 | A * | 8/2000 | Skandis | 52/177 |
| 6,449,917 | B1 * | 9/2002 | Sullivan, III | 52/506.06 |

(Continued)

FOREIGN PATENT DOCUMENTS

| | | |
|---|---|---|
| DE | 199 40 837 A1 | 11/2000 |
| DE | 102 53 553 A1 | 10/2003 |

(Continued)

*Primary Examiner* — William Gilbert
*Assistant Examiner* — Alp Akbasli
(74) *Attorney, Agent, or Firm* — Sughrue Mion, PLLC

(57) ABSTRACT

The modular flooring element (1) according to the invention comprises a panel element (2), two hooking brackets (404) arranged on a longitudinal side, two shallow recesses (44) arranged on the other longitudinal side, a hooking bracket (604) arranged on a transversal side and a shallow recess (64) arranged on the other transversal side. The brackets (404) couple with the shallow recesses (44) of another modular element, and similarly the brackets (604) couple with the shallow recesses (64), so as to block the flooring elements both longitudinally and transversally. The hooking brackets (404, 604) are provided with bearings for making the same brackets slide easier. The modular floor so provided can be assembled and dismantled quite quickly. Tongue and groove joints along the longitudinal and transversal edges render the assembled floor quite strong.

14 Claims, 9 Drawing Sheets

(56) References Cited

U.S. PATENT DOCUMENTS

| | | | | |
|---|---|---|---|---|
| 6,751,912 | B2 * | 6/2004 | Stegner et al. | 52/177 |
| 7,021,019 | B2 * | 4/2006 | Knauseder | 52/588.1 |
| 7,461,489 | B2 * | 12/2008 | Herbertsson | 52/578 |
| 7,836,651 | B2 * | 11/2010 | Krupnick | 52/392 |
| 7,849,642 | B2 * | 12/2010 | Forster et al. | 52/177 |
| 7,980,042 | B2 * | 7/2011 | Polk, Jr. | 52/587.1 |
| D656,250 | S * | 3/2012 | Forster et al. | D25/153 |
| 2004/0060255 | A1 | 4/2004 | Knauseder | |
| 2005/0108968 | A1 * | 5/2005 | Forster | 52/578 |
| 2006/0150557 | A1 * | 7/2006 | Eisermann | 52/578 |
| 2006/0265975 | A1 * | 11/2006 | Geffe | 52/177 |
| 2006/0283125 | A1 * | 12/2006 | Moller | 52/578 |
| 2007/0006544 | A1 * | 1/2007 | Washburn | 52/588.1 |

FOREIGN PATENT DOCUMENTS

| | | | |
|---|---|---|---|
| EP | 1 400 641 | A2 | 3/2004 |
| EP | 1 816 283 | A2 | 8/2007 |
| GB | 2 307 260 | A | 5/1997 |
| WO | 2006/113228 | A2 | 10/2006 |

* cited by examiner

FLOORING ELEMENT FOR A MODULAR FLOOR, MODULAR FLOOR OBTAINED THEREWITH AND METHOD FOR ASSEMBLING MODULAR FLOOR

CROSS REFERENCE TO RELATED APPLICATIONS

This application is a National Stage of International Application No. PCT/IB2008/050671 filed Feb. 25, 2008, claiming priority based on Italian Patent Application No. TO2007A00701, filed Oct. 4, 2007, the contents of all which are incorporated herein by reference in their entirety.

FIELD OF THE INVENTION

The present invention relates to a flooring element for in order to compose modular floors, particularly adapted for building trade fair-, playground- or gymnasium floors and other walk surfaces for sport uses or subject to strong tangential stresses during their use.

BACKGROUND ART

The floors of buildings such as gymnasia and playgrounds quite often undergo remarkable tangential stresses applied by the users of the playground or the gymnasium, especially if sports such as volleyball, five-a-side football or basketball are practiced on them. For example the tangential stresses may be considered, which are applied to the floor by a five-a-side football—or squash player, which suddenly stops and changes direction during running It is currently known making such floors with a continuous covering made up of only one piece of synthetic material, or of one sheet extending on the whole area of the playground—or gymnasium floor. If on the contrary one wants to make a playground—or gymnasium floor by mechanically assembling several elements of a modular covering, possibly without using chemical fastening systems such as glues or cements, the presently known systems of floor tiles, panels or staves show in a greater extent the drawbacks caused by the aforesaid tangential stresses applied by the users: such tangential forces tend to disconnect the floor tiles, -staves or -panels, causing the whole floor being quickly and unwillingly dismantled.

On the other hand, requirements of floors for trade fair stands and pavilion are allowing to be installed quickly and easily, if possible with no need of being glued or cemented to the underlying concrete slab, and being strong enough for allowing the structure above of the stand or pavilion being anchored to them.

A first object of the present invention is supplying a modular floor that is particularly resistant to the stresses during the use—in particular to the tangential stresses applied to the walk plan—and that cannot be easily dismantled by such tangential stresses. A second object of the present invention is providing a modular floor that lend itself to be assembled quickly.

SUMMARY OF THE INVENTION

The advantages attainable with the present invention will appear more evident, for a skilled person, from the following detailed description of some particular and non-limiting embodiments, given with reference to the following schematic figures.

LIST OF FIGURES

DETAILED DESCRIPTION

Figure 1:
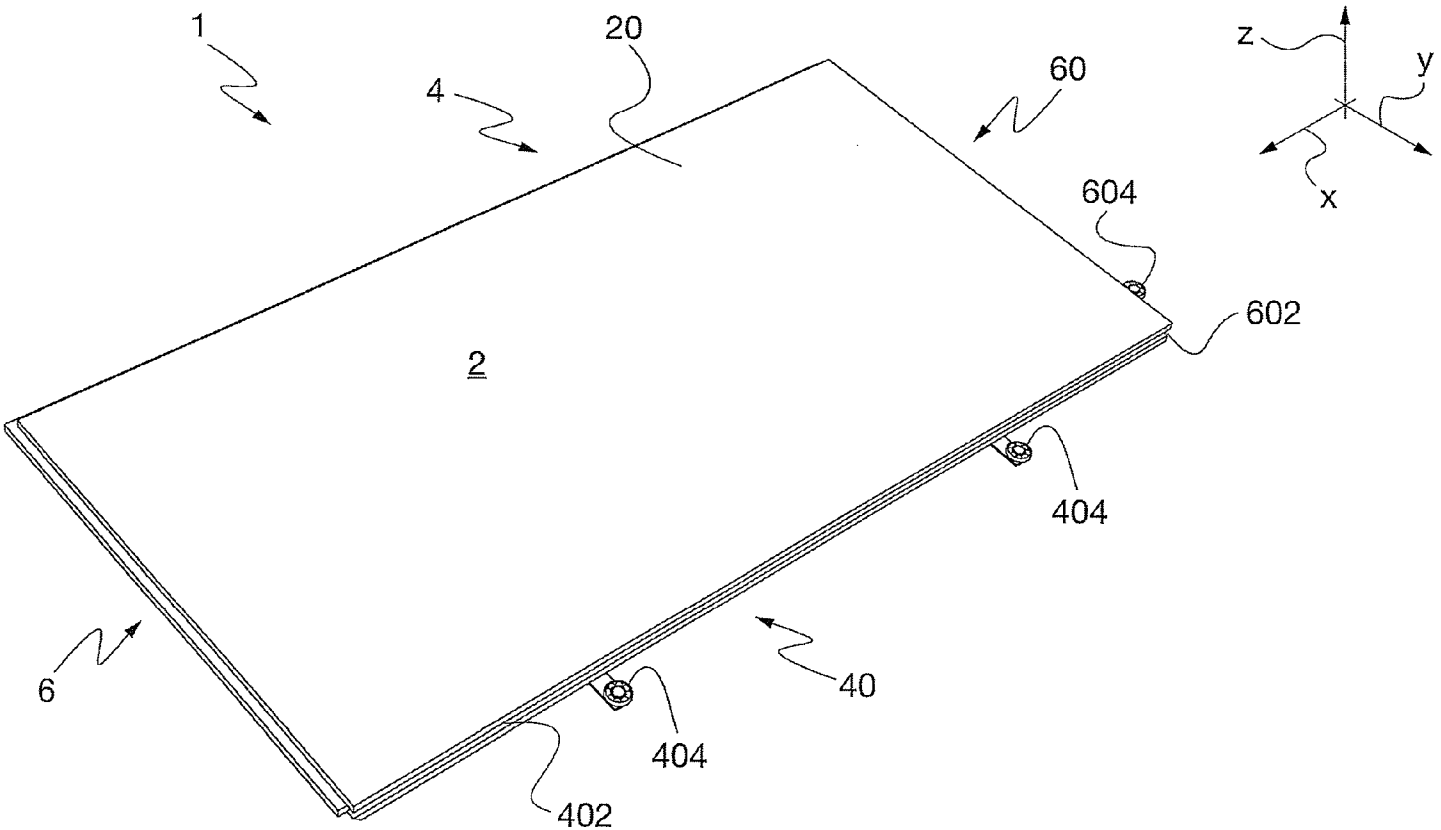
FIG. 1 shows a perspective view of a flooring element according to a first embodiment of the present invention, seen from the side of the walk face.
Figure 2:
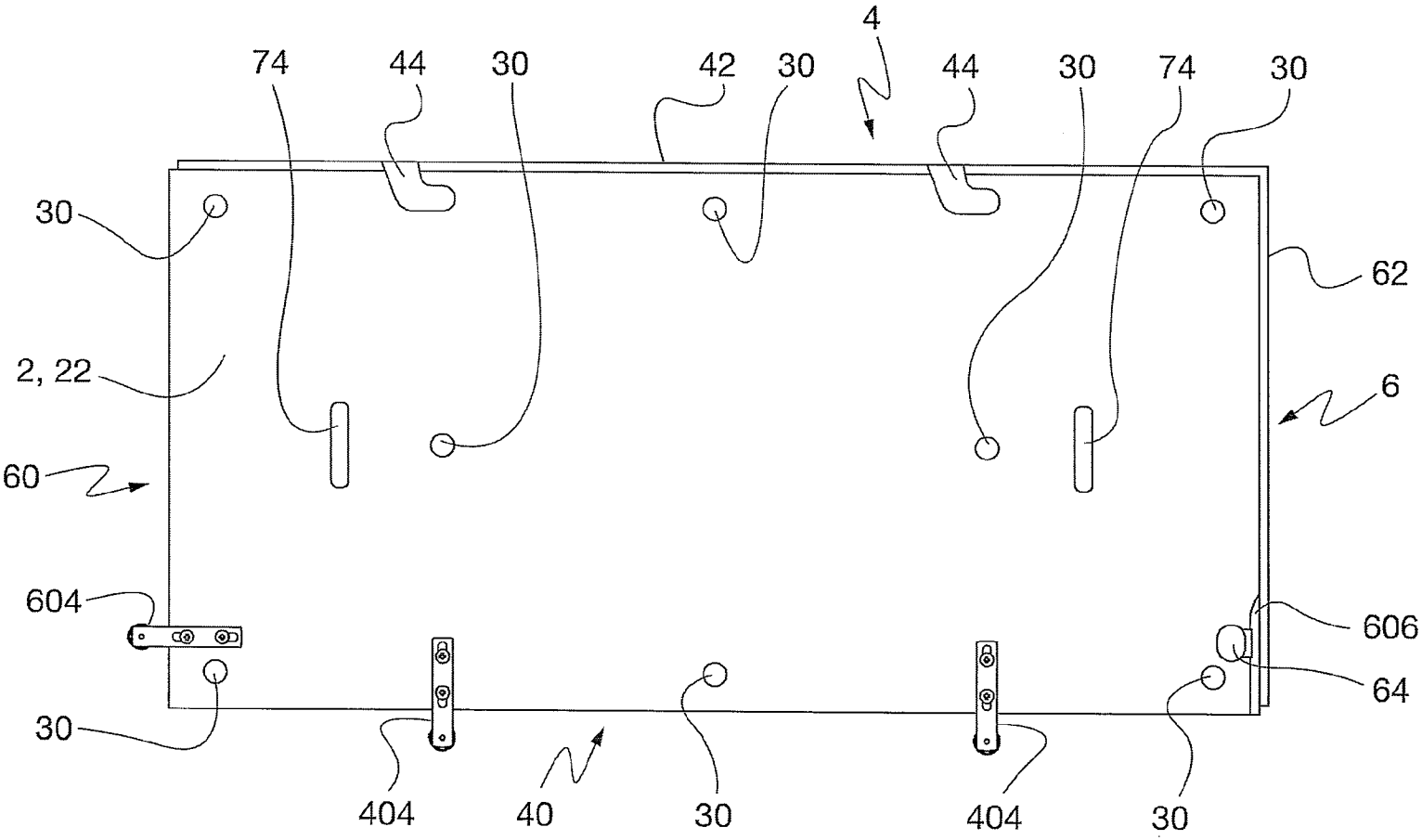
FIG. 2 shows a bottom view of the flooring element of FIG. 1.

FIGS. 1, 2 show a perspective view and a bottom view respectively, of a flooring element—referred to with the overall reference 1—for a modular floor according to the present invention. The flooring element 1 comprises a panel element 2—in the present embodiment made like a rectangular panel of laminated wood-defining:

a walk face 20 arranged for forming a part of the walk surface of the modular floor to be assembled;

a back face 22 (FIG. 2), arranged in opposite position to the walk face 20;

a first fixing side 4 and a second fixing side 6, wherein the two fixing sides 4, 6 are in general terms transversal one to the other—in the present embodiment they are orthogonal one to the other.

In the present description the direction in the space, longitudinal to the first fixing side, is conventionally referred to as "first assembling direction Y", while the direction in the space, longitudinal to the second fixing side, is conventionally referred to as "second assembling direction X". The reference Z indicates, in the present embodiment, the third axis of the triad of orthogonal axes XYZ.

In the present embodiment the panel element 2 moreover defines a third fixing side 40, parallel to first fixing side 4, and a fourth fixing side 60 parallel to the second fixing side 6; furthermore on each one of and along the first 4 and the second fixing side 6 a longitudinal fixing rib or tongue (referred to with the references 42 and 62 respectively—FIG. 1) is provided, while on each one of and along the third 40 and fourth fixing side 60 a longitudinal fixing groove (referred to as with the references 402 and 602 respectively—FIGS. 1, 2) are provided. The fixing tongues 42, 62 and the fixing grooves 402, 602 are shaped so as to be able to form—together with the fixing tongues and grooves of other flooring elements 1, as explained in better detail later on—the so-called "tongue and groove joints" (in English "tongue and groove" joint), known per se. The longitudinal tongue and groove joints have the function to prevent two flooring elements from being disconnected in directions normal to the plan of the panel elements 2.

According to the present invention, the flooring element 1 for the modular floor comprises:

a) a panel element 2; and b) a first 44 and a second fastening system 64;

wherein the panel element 2 in its turn comprises:

a.1) a walk face 20 arranged for forming a part of the walk surface of the modular floor, and a.2) a back face 22 arranged in opposite position to the walk face 20;

a.3) a first fixing side 4 and a second fixing side 6, arranged transversally one relative to another;

wherein the first fastening system 44, 404 is arranged for fixing together the flooring element 1 to an analogous second flooring element (1', 1", 1''', $1^{IV}$) of the modular floor so as to prevent the relative displacements thereof at least in a first assembling direction Y;

and wherein the second fastening system (64, 604, 80, 82) is arranged for fixing together one with another the second fixing side 6 of the flooring element 1 with a fixing side (4, 40, 60) of a third analogous flooring element (1', 1", 1''', $1^{IV}$) of the modular floor so as to prevent the relative displacements of the flooring element 1 and the third analogous flooring element (1', 1", 1''', $1^{IV}$), at least in a second assembling direction X transversal to the first assembling direction Y.

Figure 3:
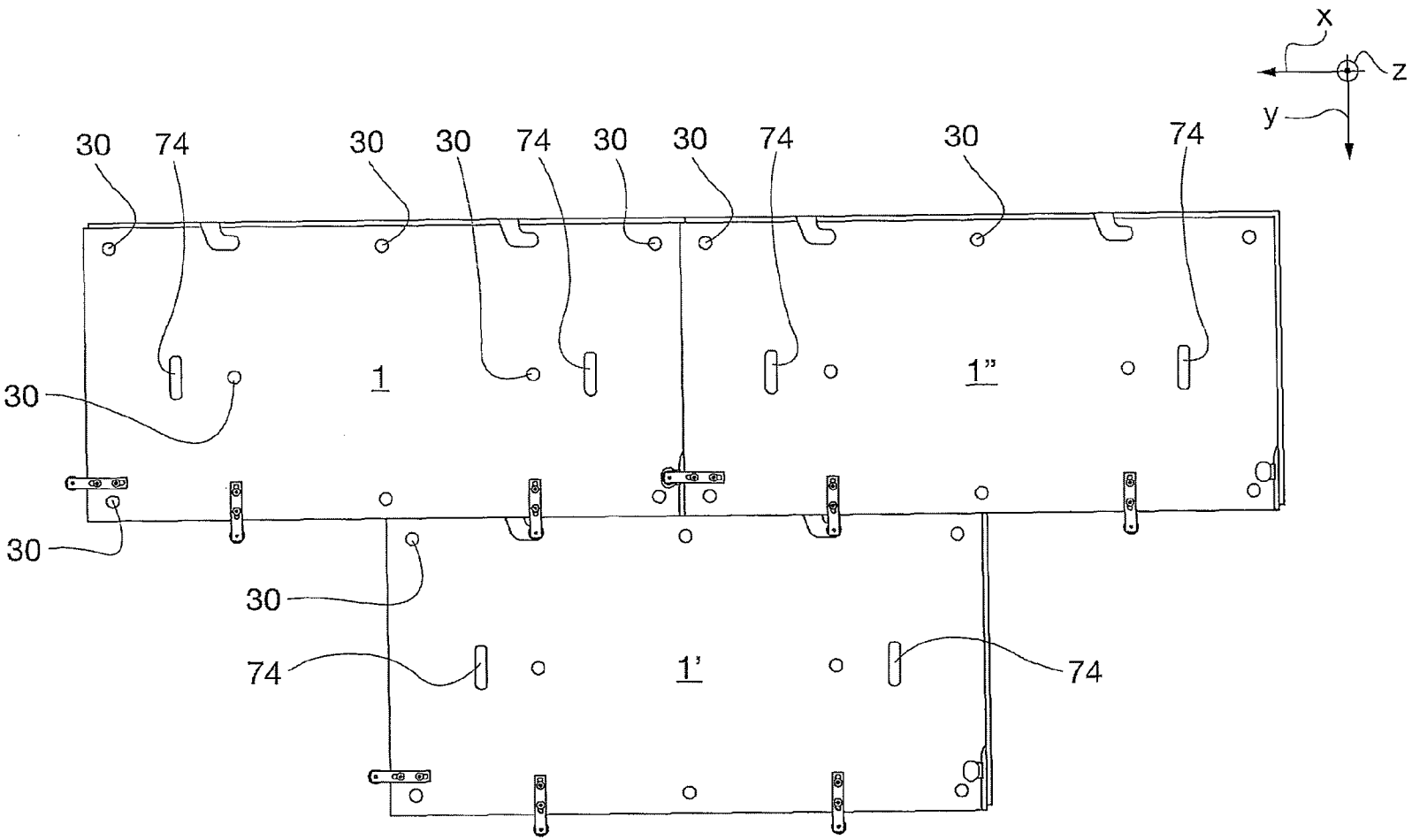
FIG. 3 shows a bottom side of three flooring elements like the one of FIG. 1, assembled together.

In the embodiment of FIGS. 1-6, the first fastening system comprises two hooking recesses 44, arranged near the first fixing side 4, and two hooking brackets 404 arranged near the third fixing side 40. The hooking recesses 44 and the hooking brackets 404 are arranged in such way that the hooking brackets 404 of a first modular flooring element 1 can engage with the corresponding hooking recesses 44 of a second modular flooring element 1' so as to keep the first fixing side 4 of the modular element 1 connected to the third fixing side 40 of modular element 1', preventing their mutual displacements in the first assembling direction Y (FIG. 3). Still in the embodiment of FIGS. 1-6, the second fastening system comprises a hooking recess 64, arranged near the second fixing side 6, and a hooking bracket 604 arranged near the fourth fixing side 60. The hooking recess 64 and the hooking bracket 604 are arranged in such way that the hooking bracket 604 of a third modular flooring element 1" can engage with the corresponding hooking recess 64 of the first modular flooring element 1 so as to keep the second fixing side 6 of the modular element 1 connected with the fourth fixing side 60 of the modular element 1", preventing their mutual displacements in the second assembling direction X.

Figure 4A:
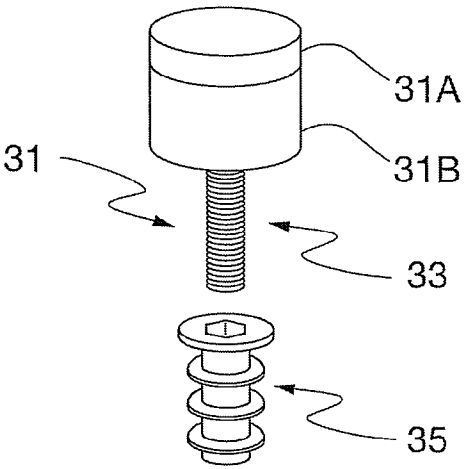
FIG. 4A shows an exploded view of the support spacer of FIG. 4.
Figure 4:
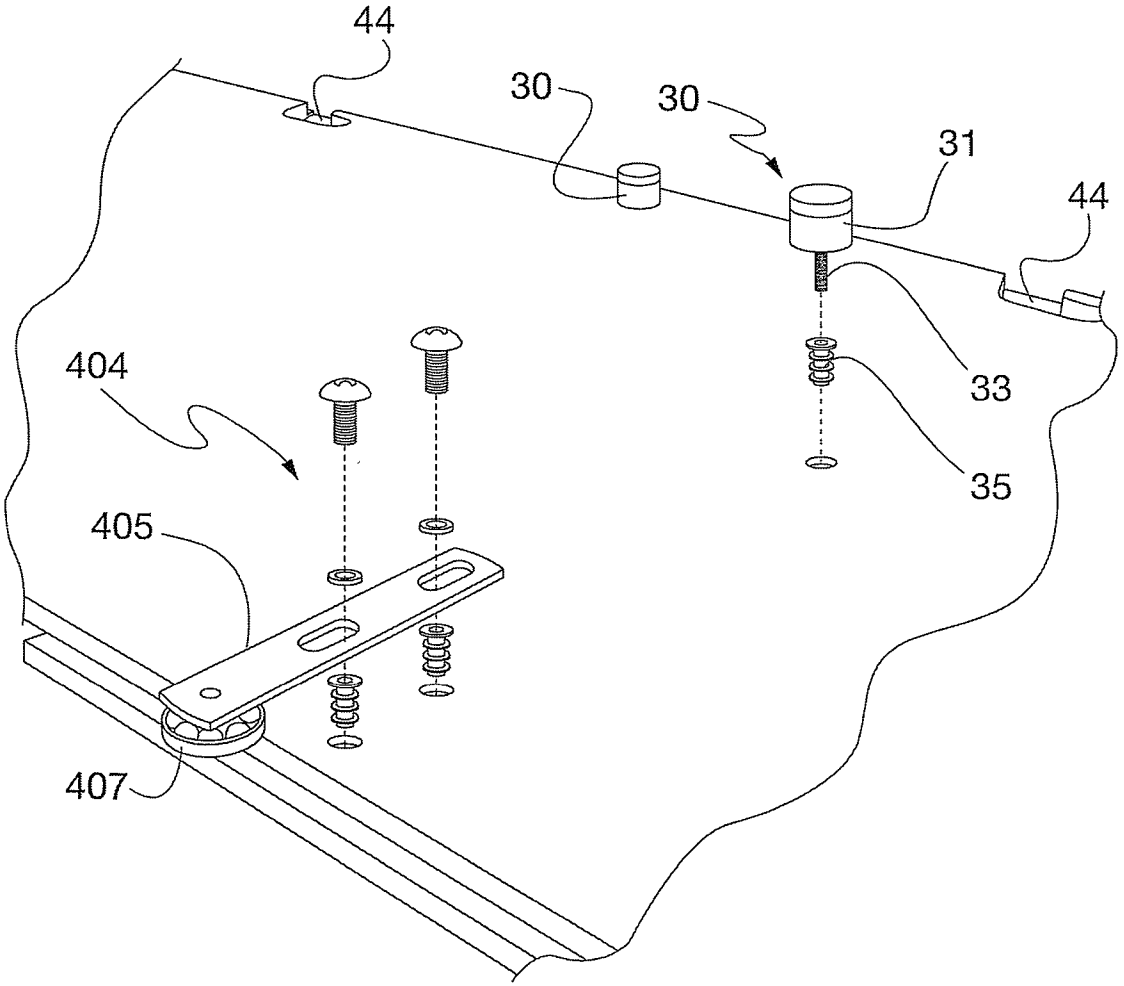
FIG. 4 shows, in a perspective exploded view, the details of a hooking bracket and a support spacer of the flooring element of FIG. 1.
Figure 5:
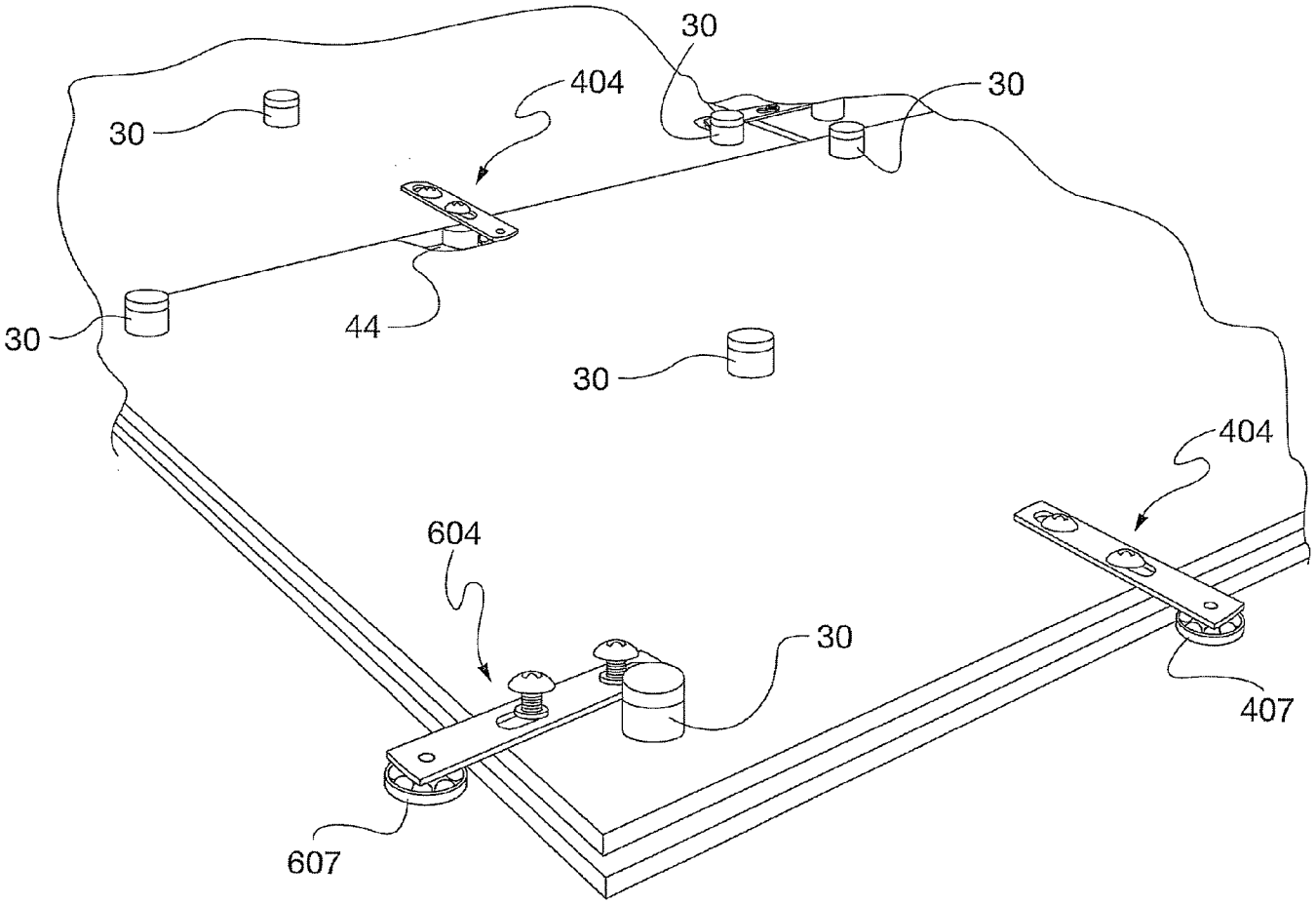
FIG. 5 shows a further perspective view of the flooring element of FIG. 1.
Figure 6:
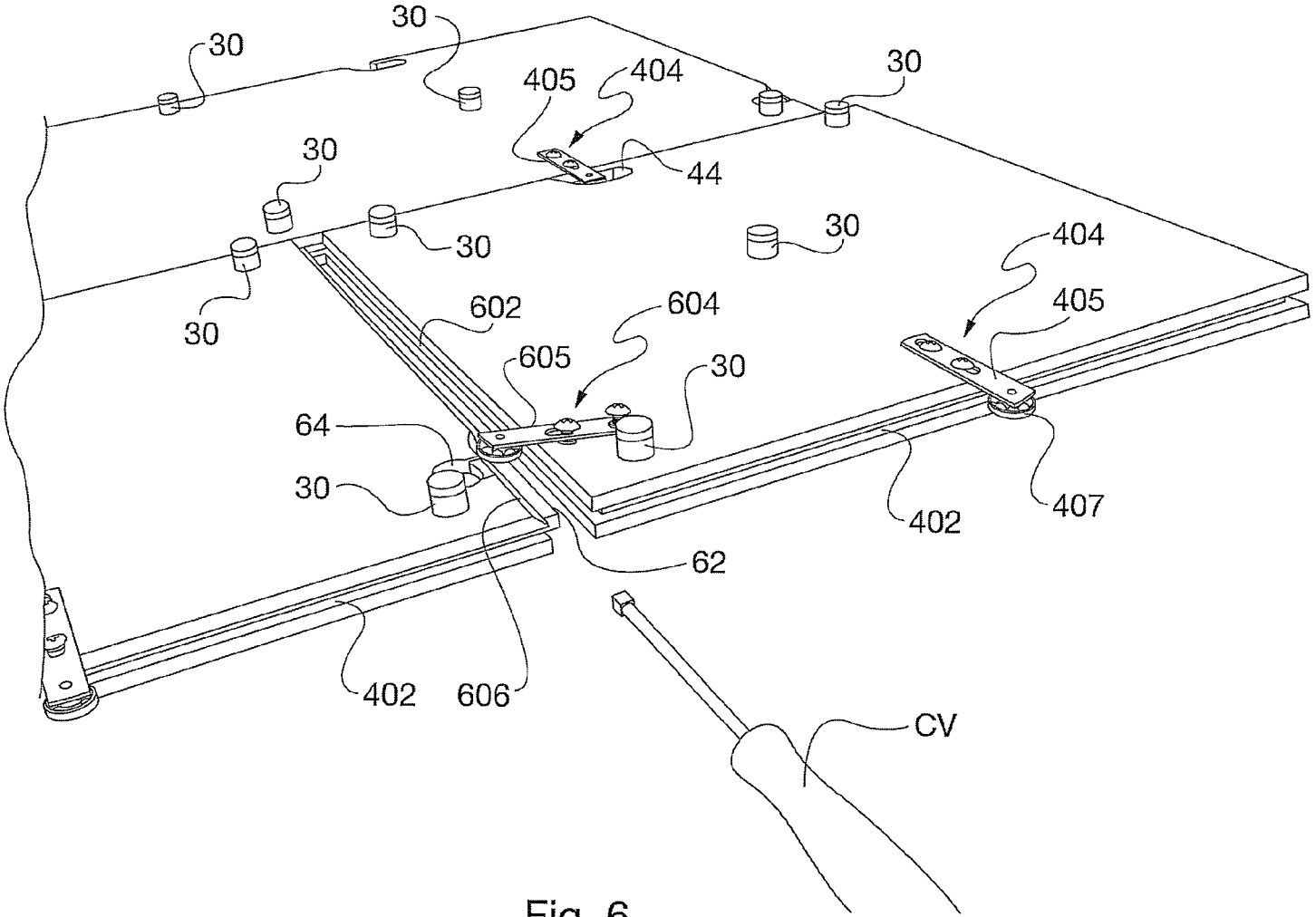
FIG. 6 shows a perspective view of the three flooring elements of FIG. 3, while being disassembled.

As shown in FIGS. 4-6, in the present embodiment the hooking recesses 44 and 64 are made as shallow recesses milled in the panel element 2 of the elements 1, 1', 1"; still in the present preferred embodiment, the hooking recesses 44 and 64 have a constant depth. On the contrary the hooking brackets 404, 604 comprise a tongue, that is a small cantilever beam 405, 605 respectively, fixed on the panel element 2 so as to protrude out from the edge 40, 60 respectively.

On the end of each tongue 405, 605 a bearing 407, 607 respectively is arranged. In the embodiment of FIGS. 1-6 such bearings 407, 607 are made as rolling bearings, such as ball—or roller bearings, known per se, and have the function of entering and engaging with the shallow recesses 44, 64—so as to connect several modules 1, 1', 1" one with another—helping the sides 4, 40, 6, 60 of two different modular elements coupled together to slide one along another. Such bearings can be made of metallic or non-metallic materials, such as a suitable plastic. The bearings 407, 607 moreover help each bracket 404, 604 to slide in the shallow recess 44, 64 with which is coupled. In general terms, the bearings 407, 607 help the different modular flooring elements assembling be mounted, settled and positioned during the assembling, making such assembling much faster and less laborious. Alternatively the bearings can be provided as friction bearings, such as in the embodiment of FIG. 7: in such embodiment, the friction bearing 407', 607' is made up of a simple cylindrical pad of plastic material; preferably such plastic material has a low friction coefficient, so as to favour the relative displacements previously described between several modular elements; to this purpose such plastic material can be for example polyamide (nylon, PA), polyethylenterephtalate (PET), polytetrafluoroethylene (teflon, PTFE), acetic resin (POM, that is polyoxymethylene) and mixtures thereof; such materials can moreover contain inert fillers such as 10-20% content of glass.

Furthermore the aforesaid friction bearings can be made not only of plastics, but also of other materials, such as ceramic materials, wood, glass, steel, bronze, brass, aluminum, cast iron, zinc and alloys thereof, metallic materials in general, self-lubricating and non self-lubricating materials. In general terms the material of the friction bearings 407', 607' is such to give rise to a relatively low friction coefficient, with the material of the flooring element with which it is coupled. Just as an indication such relatively low friction coefficient is chosen between the following:

a friction coefficient equal to or lower than three times the friction coefficient of polyamide;

a friction coefficient equal to or lower than 1, more preferably equal to or lower than 0.5 and, still more preferably, equal to or lower than 0.2-0.3.

In the present description the indications on the friction coefficient and its respective values are to be understood as the static friction coefficient of the material of the aforesaid friction bearing with dry steel.

In order to help the bearings 407, 607 to slide on the surfaces of the shallow recesses 44, 64, such bearings preferably have cylindrical, elliptic, oval or however smooth shape, particularly on their flanks In order to allow the modular floor be easily assembled, at least the brackets 604, and possibly also the brackets 404, are suitably articulated or elastic enough so as to allow a sufficient displacement of the respective bearings 607,407 in a direction normal to the plan in which the panel element 2 lies.

For this purpose the tongues 405, 605 can be arranged in such a way that they can bend enough in a direction normal to the plan in which the respective panel element 2 lies.

Figure 7:
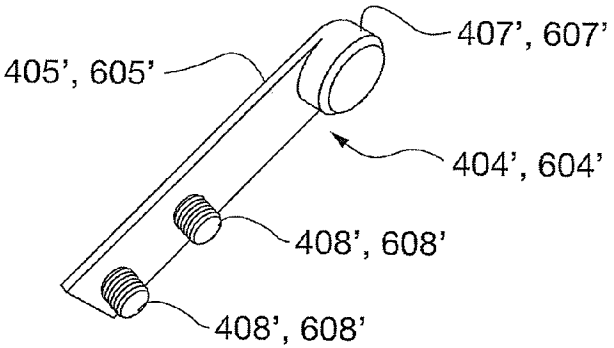
FIG. 7 shows, in perspective view, a hooking bracket of a flooring element according to a second embodiment of the present invention.

In the embodiment of FIG. 7, wherein the hooking bracket 404', 604' is made up of only one piece of plastic material that forms the tongue 405', 605', the friction bearing 407', 607' and the dowels 408', 608' for fixing the bracket to the panel element 2 by fitting, the displacements of bearing 407', 607' in a direction normal to the plan in which the panel element 2 lies are obtained through a suitable flexibility of the tongue 405', 605'.

Figure 8:
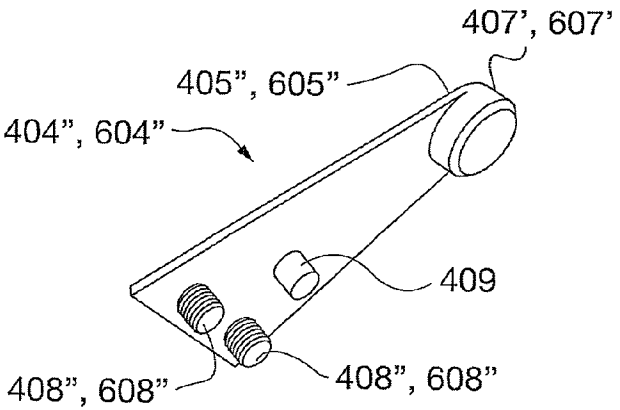
FIG. 8 shows, in perspective view, a hooking bracket of a flooring element according to a third embodiment of the present invention.

Also in the embodiment of FIG. 8 the hooking bracket 404", 604" is made up of only one piece of plastic material forming both the tongue 405", 605", the friction bearing 407', 607' and the dowels 408", 608" for fixing the bracket to the panel element 2 by fitting; however, unlike the embodiment of FIG. 7, dowels 408", 608" are equally spaced from the bearing 407', 607' and a third guide pin 409 is arranged in a middle position between the dowels 408", 608" and the bearing 407', 607'. While dowels 408", 608" are fitted with interference in the panel element 2, during the use of the modular flooring element the guide pin 409 is put in a hole made in the panel element 2 and can freely slide with clearance relative to it. The equidistance of the fixing dowels 408", 608" from the bearing 407', 607' reduces the internal stresses of the hooking bracket 404", 604" and consequently the probabilities of break.

Figure 9:
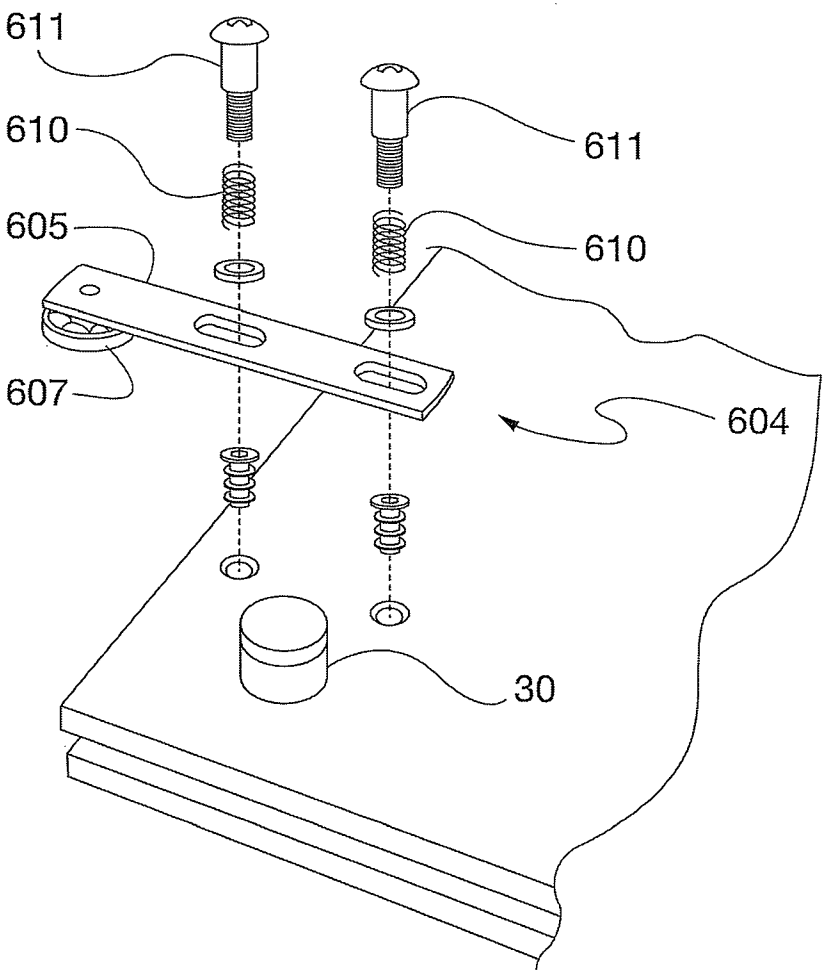
FIG. 9 shows, in perspective and exploded view, a hooking bracket arranged on the fourth fixing side of the flooring element of FIG. 1.

On the contrary, in the embodiment of FIG. 9 the tongue 607 is obtained from a little and more rigid metallic bar or strip, and the displacements of the bearing 607 in a direction normal to the plan in which the panel element 2 lies are obtained thanks to the springs 610 and the hinges 611, which allow the bar 605 to rotate so as to allow an easy assembling of the floor, as it will be explained more deeply later on.

The shallow recess 64 of each modular element 1 is opened on no fixing side of the panel element 2, while the shallow recess 44 preferably is opened, or ends up, on the fixing side 4.

Preferably each of the shallow recesses 44 has a substantially elongated shape and defines a section 45 oblique to the edge of the fixing side 4 (FIG. 2A): such oblique section forces the two fixing sides 4, 40 of two different modular elements 1, 1', that are connected one with another, to slide along the same fixing sides, allowing the fixing tongue be easier inserted in the fixing groove 402 of the other modular element.

Figure 2B:
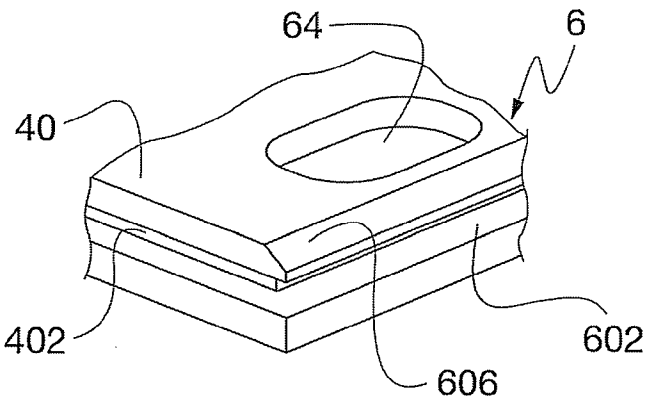
FIG. 2B shows the perspective view of a detail of a hooking recess, arranged at the second fixing side of the flooring element of FIG. 1.
Figure 2A:
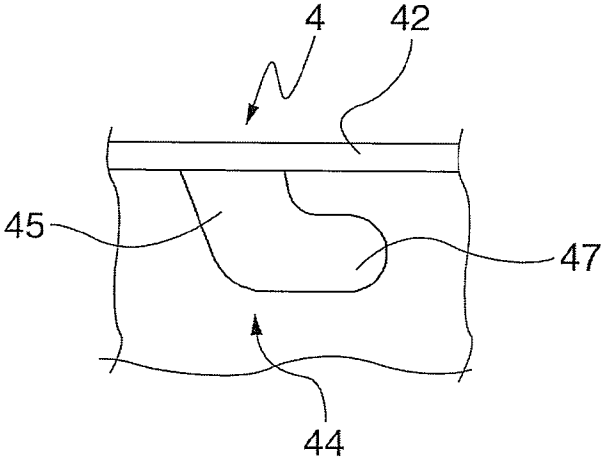
FIG. 2A shows the bottom view of a detail of a hooking recess, arranged at the first fixing side of the flooring element of FIG. 1.

Preferably, in order to couple several modular elements 1 more firmly one with another, the shallow recess 44 forms a fold and further form a section 47 extending substantially parallel, or however longitudinally to the edge of the fixing side 4, as shown in FIG. 2A.

Preferably the shallow recesses 44 arranged near the first fixing side 4 have substantially the same shape of each other, in order to simplify the assembling of the floor.

Advantageously the shallow recess 64 located near the second fixing side 6 is arranged close to an angle, or however to an end of said fixing side 6, so as to allow the hooking bracket 604, that must be engaged with the shallow recess 64, be reached more easily with a screwdriver CV (FIG. 6) or another tool, and so as to make dismantling of the floor easier, as it will be explained more deeply later on.

Advantageous, as shown in FIG. 2B, in order to make the assembling of the floor easier, a sufficient section of the second fixing side 6 located in front of the shallow recess 64 is provided with a slanted surface 606, having the function of raising the bearing 607 of another modular element 1 and allowing the bearing 607 be easier inserted in the shallow recess 64, as it will be explained more deeply later on.

Advantageously on the back face 22 of the panel element 2 of a module 1, 1', 1" one or more further recesses 74 are provided, in a more central position relative to the shallow recesses 44 and 64. In the present description the further recesses 74 are referred to as "handling recesses" 74. For example each one of such recesses can be made as a milled, molded or pressed shallow recess. The function of the handling recesses is allowing the floor be quicker installed and dismantled by means of the tool shown in FIG. 10, the use of which will be described later on. Advantageously on each back face 22 of a module 1, 1', 1" at least two handling recesses are provided, arranged preferably along the longitudinal symmetry axis of the panel element 2.

An example will be now described, of the assembling of a modular floor made up of several flooring elements 1, 1', 1" previously described.

Referring to FIG. 3, the assembling can begin laying the element 1" on a raw and non-modular floor, such as a concrete—, tiled—or beaten earth floor. Another element 1 is drawn close to the first element 1" pushing the former in the direction X, from left towards right with reference to FIG. 3: the bearing 607" of the module 1" reaches and is lifted by the slanted edge 606 of module 1; therefore the bearing 607" passes easily over the edge of the side 6 and enters the shallow recess 64 of the module 1 (FIG. 6), preventing the two modules 1 and 1" from sliding along the direction X; at the same time the fixing tongue 62 of module 1 enters and engages with the fixing groove 602 of module 1", preventing the mutual displacements between the two modules 1, 1" in a direction normal to the planes in which they lie.

Subsequently the modular element 1' is drawn close to the assembly of modules 1+1", making it to slide along the direction Y, so that the two shallow recesses 44 of module 1' are entered by the bearings of a hooking bracket 404 of module 1, and of a hooking bracket 404" of module 1", as shown in FIG. 3; at the same time the fixing tongue 42' of module 1' enters and engages the fixing grooves 402 and 402" of modules 1 and 1" respectively.

Clearly the three modules 1, 1' and 1" can be assembled also in a different order, for instance by coupling modules 1' and 1" first, and then coupling module 1 to such assembly, or still in other ways.

An assembled floor made up of several modules 1, 1', 1" as previously described can be dismantled for instance as follows.

The tongue 605 of a peripheral module 1 can be raised with a screwdriver CV, or with another tool, and the relative bearing 607 is uncoupled from the shallow recess 64 of the adjacent module: then one module 1 is removed (FIG. 6). Dismantling goes on disconnecting and removing the remaining modules.

Thanks to the previous teachings, it is possible to provide quite strong prefabricated modular floors which are not disconnected by the remarkable stresses applied for instance by a team of basket-, five-a-side football players or other athletes playing or practicing sports thereon. Moreover the modular floors described above can be mounted and dismantled in quite short times, especially in comparison to the existing modular floors.

Returning now to the description of the embodiment of FIGS. 1-6, 9, each one of such modules 1, 1', 1" is provided, on its back face 22, of a plurality of support spacers 30, on which the panel element 2 rests remaining raised regarding the fixed floor below.

One of such pads 30 is shown in greater detail in FIGS. 4, 4A.

The support spacer 30 comprises a pad body 31, made of a relatively soft and elastic material such as a synthetic or natural rubber. A threaded stem 33—for instance made of metal—is partly buried in and partly protruding from the pad body 31. The metal stem 33 allows the pad body 31 be fixed by screwing to a recess-fit bushing 35, which is fitted or however permanently forced in the panel element 2 of a flooring module of floor 1, 1', 1", as shown in the exploded view of FIG. 4. The connection between the threaded stem 33, and the corresponding threaded seat of the bushing 35, is suitably lubricated, or in any case provides a friction sufficiently low between the stem 33 and the threaded seat of the bushing 35.

When the modular floor is assembled, the several modules 1, 1', 1" can be assembled for example having the pad bodies of the different spacers 30 completely screwed in their respective bushings 35, or with a random extent of screwing, with no need that the staff charged with the assembling carries out a fine adjustment of the height of pads 30 by unscrewing or screwing them to a greater or lesser extent.

With a suitable choice of the aforesaid friction between stem 33 and bushing 35, it is possible to arrange that, because of the passage of people—such as public, athletes, players or sportsmen in general—on the walk surface 20, of vibrations and in general terms of the use of the floor, the threaded stems 33, of the pads which do not touch the underlying fixed floor, come unscrewed until every pad 31 touches said fixed floor. In this way a self-leveling floor is provided, that is a floor that levels itself and increases its flatness by itself after it has been assembled, thanks to the simple walking of the end users.

The threaded stem 33 can even have a usual standard thread—such as a M6-thread—provided that its friction with the internal thread in which the stem is screwed it made sufficiently low, for example by lubricating it with silicone lubricants, mineral oils, graphite powder or still other lubricants.

Advantageously the threaded stem 33 forms an irreversible internal+external screw connection with the internal thread in which it is screwed; in other words, the inclination of the helix of the thread relative to the thread axis is sufficiently sloping so as to substantially prevent a load applied along the thread axis from causing the threaded stem being screwed or unscrewed. Advantageous, in order to help a better arrangement of the pads, the end of the pad body 31 resting against the fixed floor or other underlying substrate is covered with a layer of material 31A having a relatively low friction coefficient, and in particular lower than the friction coefficient between the underlying fixed floor and the relatively soft and elastic material of the rest of pad body 31; for instance the covering 31A can be made of nylon or teflon, while the intermediate portion 31B of the pad body 31 can be made of a suitable elastomer having a lower Shore-hardness than that of the covering 31A. In general terms and preferably the hardness of the material of the covering 31A is greater than that of the material of the pad intermediate portion 31B.

Figure 10:
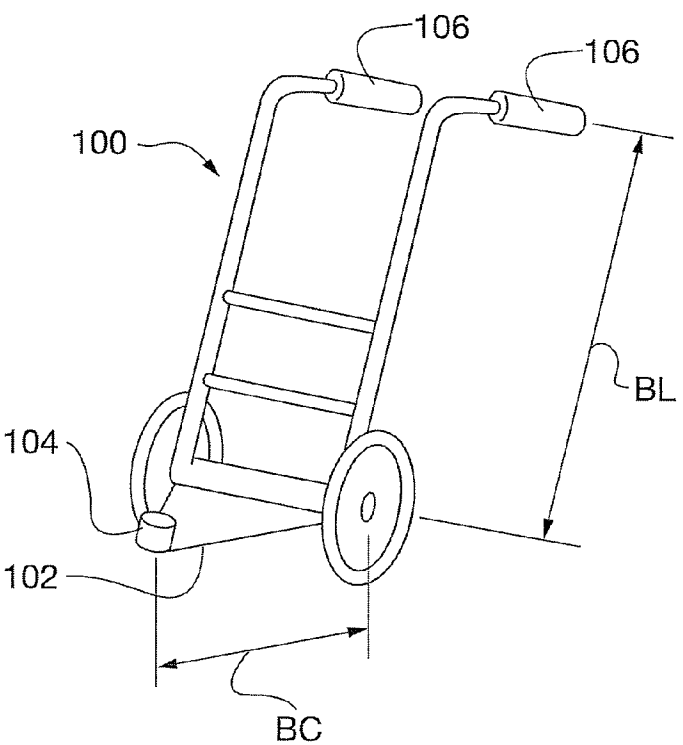
FIG. 10 shows, in perspective view, a trolley for assembling, dismantling and handling the flooring elements of the previous Figures.

The assembling and dismantling will be now described, of the modular floor previously described, by means of the tool shown in FIG. 10.

Such tool, referred to with the overall reference 100, has substantially the shape of a trolley for manual use mounted on wheels.

In its front lower part the trolley 9 is provided with an assembling protrusion 102, obtained for example from a metal sheet or plate. At the end of the assembling protrusion an assembling pin 104—or however a male element—is fixed and directed upwards.

The assembling male 104 has such shape and dimensions allowing it be inserted in the handling recesses 74 of the modular elements 1, 1', 1".

The trolley or tool 100 is arranged for allowing the assembling protrusion 102 be inserted under a panel element 2—which it is kept raised above the ground by the support spacers 30—by simply making the trolley to slide on its wheels, and the assembling male 104 be inserted in one of the handling recesses 74 of panel 2. Acting on the handles 106 of the trolley, and helped by from the favourable lever arms BC and BL, wherein it is preferably BL>BC, an operator can seize and handle a module 1, 1', 1" easily and with no effort for assembling or dismantling a modular floor according to the invention; in particular, with a suitably dimensioned trolley 100, an operator can take, handle and put down one or more modules 1, 1', 1", possibly stacked, with no need of bowing or kneeling down.

Also the trolley 100 and the handling recesses 74 remarkably contribute to allow the modular floor according to the invention, or still other floors, be assembled and dismantled quicker.

It is further noted that the low friction coefficient of the covering 31A of the support spacers 30 (FIG. 4A) allow the modules 1, 1', 1" be dragged easier with the trolley 100, while the spacers 30 avoid or remarkably limit the damages to and the dirt on the rest of the panel when it is handled with the trolley 100, or however when the modules 1, 1', 1" are dragged on the ground. The preferred embodiments previously described are susceptible of various modifications and variations without departing from the scope of the present invention. The examples and list of possible variations in the present application are to be understood as non-exhaustive lists.

The invention claimed is:

1. A modular flooring system, comprising:

panels, including a first panel, a second panel, and a third panel, each of the panels comprising:

a walk face configured to form a part of a walk surface of the modular floor;

a back face on a side of the panel opposite to the walk face;

a first fixing side;

a second fixing side transverse to the first fixing side;

a third fixing side parallel to first fixing side;

a fourth fixing side parallel to the second fixing side;

a first fastening system comprising first and second hooking recesses arranged at or near the first fixing side, and first and second hooking brackets arranged at or near the third fixing side, the hooking recesses and the hooking brackets configured so that the hooking brackets of a first panel are mechanically engageable with corresponding hooking recesses of the second panel so as to keep the first fixing side of the first panel connected to the third fixing side of the second panel, thereby preventing relative displacement between the first panel and the second panel in a first direction;

a second fastening system configured to fasten together the second fixing side of the first panel to the third panel, so as to prevent relative displacement between the first panel and the third panel at least along a second direction transverse to the first direction; the second fastening system comprising a hooking recess at or near the second fixing side, and a hooking bracket at or near the fourth fixing side, the hooking recess and the hooking bracket of the second fastening system configured such that the hooking bracket of the third panel is mechanically engageable with the corresponding hooking recess of the first panel so as to prevent relative displacement between the first panel and the third panel in the second direction;

wherein each of the hooking brackets of the panels comprises a cantilevered tongue protruding out from a corresponding fixing side, the tongue comprising a bearing, the bearing having a cylindrical body with a cylindrical axis passing through centers of bases of the cylindrical body, the cylindrical body oriented with the cylindrical axis normal to the walk face.

2. The modular flooring system according to claim 1, wherein for each panel, at least one of the hooking brackets is elastic so as to allow displacement of the respective bearings in a direction normal walk face to facilitate assembly of the panels.

3. A flooring element for a modular floor, comprising:

a) a panel element; and b) a first and a second fastening system;

wherein the panel element in its turn comprises:

a.1) a walk face arranged so as to form a part of a walk surface of the modular floor, and a.2) a back face arranged opposite to the walk face;

a.3) a first fixing side and a second fixing side, arranged transversally one to another;

a.4) a third fixing side, parallel to the first fixing side, and a fourth fixing side parallel to the second fixing side;

a.5) longitudinal tongue and groove joints provided on and along said four sides configured to prevent the flooring elements from being disconnected in directions normal to the plan of the panel elements;

wherein:

the first fastening system is arranged for fastening the flooring element to an analogous second flooring element of the modular floor preventing relative displacements at least along a first assembling direction;

said first fastening system comprising first and second hooking recesses, arranged near the first fixing side, and first and second hooking brackets arranged near the third fixing side, the hooking recesses and the hooking brackets being arranged in such a way that the hooking brackets of a first modular flooring element are mechanically engageable with corresponding hooking recesses of a second modular flooring element so as to keep the first fixing side of the first modular element connected to the third fixing side of the second modular element, preventing their mutual displacements in the first assembling direction;

and wherein:

the second fastening system is arranged for fastening together the second fixing side of the flooring element and a fixing side of a third analogous flooring element of the modular floor, so as to prevent the relative displacements between the flooring element and the third analogous flooring element at least along a second assembling direction transversal to the first assembling direction;

said second fastening system comprising a hooking recess, arranged near the second fixing side, and a hooking bracket arranged near the fourth fixing side, the hooking recess and the hooking bracket being arranged in such way that the hooking bracket of a third modular flooring element is mechanically engageable with the corresponding hooking recess of the first modular flooring element so as to keep the second fixing side of the modular element connected with the fourth fixing side of the modular element, preventing their mutual displacements in the second assembling direction, wherein each of said hooking brackets comprises a tongue made as a cantilever beam, fixed on the panel element so as to protrude out from the edge thereof and provided on an end of the tongue with a bearing for allowing the hooking bracket to slide easier against and/or in the corresponding portion of the other analogous flooring element, said bearing having a cylindrical body with a cylindrical axis passing through centers of bases of the cylindrical body, the cylindrical body oriented with the cylindrical axis normal to a plane in which the walk face lies; and at least some of said brackets, are suitably articulated or elastic enough so as to allow a sufficient displacement of the respective bearings in a direction normal to the plan in which the panel element lies in order to allow the modular floor to be easily assembled.

4. The flooring element according to claim 3, wherein the first assembling direction is parallel or coplanar to the walk face and transversal to the first fixing side.

5. The flooring element according to claim 3, wherein the second assembling direction is parallel or coplanar to the walk face and transversal to the second fixing side.

6. The flooring element according to claim 3, wherein the hooking bracket comprises a protrusion on which the bearing is fixed.

7. The flooring element according to claim 6, wherein the bearing comprises one or more elements chosen from the following set:

a rolling bearing;

a friction bearing;

a body made of self-lubricated material;

a body made of polyamide (nylon, PA), polyethylenterephtalate (PET), polytetrafluoroethylene (teflon, PTFE), acetic resin (POM, that is polyoxymethylene) and mixtures thereof;

a body made of plastic material having a friction coefficient equal to +30% of the friction coefficient of teflon or nylon;

a body made of wood, glass, ceramic material, steel, bronze, brass, aluminum, cast iron, zinc and relative alloys, metal in general;

a material having a coefficient of friction, with the material of the flooring element with which it is coupled, equal to or lower than 1;

a material having a coefficient of friction, with the material of the flooring element with which it is coupled, equal to or lower than three times the friction coefficient of polyamide (nylon, PA) or of the polytetrafluoroethylene (teflon, PTFE);

a substantially cylindrical body arranged so that its flanks engage and slide against and/or in the corresponding portion of the other analogous flooring element;

a body having substantially smooth flanks and arranged for engaging and sliding against and/or in the corresponding portion of the other analogous flooring element;

a pin arranged for engaging and slide against and/or in the corresponding zone of the other analogous flooring element;

a pin having circular, oval or elliptic cross-sections;

a pin the flanks of which form a surface of revolution.

8. The flooring element according to claim 3, wherein the hooking recess has a substantially oblong shape.

9. The flooring element according to claim 3, wherein the hooking recess comprises a first section extending transversally to the edge of the flooring element which is closest to the hooking recess.

10. The flooring element according to claim 9, wherein the hooking recess comprises a second section extending longitudinally to the edge of the flooring element closest to the hooking recess.

11. The flooring element according to claim 3, wherein the hooking recess forms a fold or elbow.

12. The flooring element according to claim 3, comprising a support spacer arranged for supporting a panel element and spacing it from the surface on which the support spacer rests.

13. The flooring element according to claim 12, comprising a plurality of support spacers, wherein at least some of the support spacers are fixed to the panel element by means of a threaded connection, and the threaded connection is arranged for allowing its respective support spacer to come unscrewed during the use of the flooring element and to contact the surface on which other support spacers rest.

14. The flooring element according to claim 12, wherein the support spacer is provided with a pad body which in its turn comprises a support end and an intermediate section connecting the support end and the panel element, and the support end is arranged for sliding on the surface on which the flooring element rests, with a friction smaller than the friction between such surface and the intermediate section.

* * * * *